United States Patent [19]

Alperin et al.

[11] Patent Number: 4,651,362

[45] Date of Patent: Mar. 24, 1987

[54] CONVERTIBLE SOFA-BED

[76] Inventors: Marvin Alperin, 6501 Maryland Dr., Los Angeles, Calif. 90048; Joseph L. Brassner, 4830 La Montana Cir., Tarzana, Calif. 91356

[21] Appl. No.: 857,770

[22] Filed: Apr. 29, 1986

[51] Int. Cl.[4] ..... A47C 17/14; A47C 17/32; A47C 19/02

[52] U.S. Cl. ..... 5/12 R; 5/51 B; 5/53 R; 5/201; 5/285; 29/401.1

[58] Field of Search ..... 5/2 R, 12 R, 51 B, 53 R, 5/7, 201, 285, 175, 183, 184, 185; 29/401.1

[56] References Cited

U.S. PATENT DOCUMENTS

| | | | |
|---|---|---|---|
| 823,327 | 6/1906 | Magerdon | 5/53 R |
| 990,401 | 4/1911 | Stanyon | 5/285 |
| 1,075,291 | 10/1913 | Kertlsz | 5/285 |

FOREIGN PATENT DOCUMENTS

| | | | |
|---|---|---|---|
| 617891 | 11/1926 | France | 5/185 |

*Primary Examiner*—Alexander Grosz

*Attorney, Agent, or Firm*—Freilich, Hornbaker, Rosen & Fernandez

[57] ABSTRACT

A convertible sofa-bed is provided, which uses the highy-decorative frame assembly of a sofa to create two beds that each have highly-decorative headboards and footboards. The sofa frame assembly includes decorative end frames and a decorative back frame, the back frame having opposite end sections that can be separated and which each have a width about equal to the width of an end frame. Legs mounted on the back frame convert into a decorative footboard for not only holding a mattress support but also for providing a highly-decorative bed.

8 Claims, 6 Drawing Figures

FIG. 1
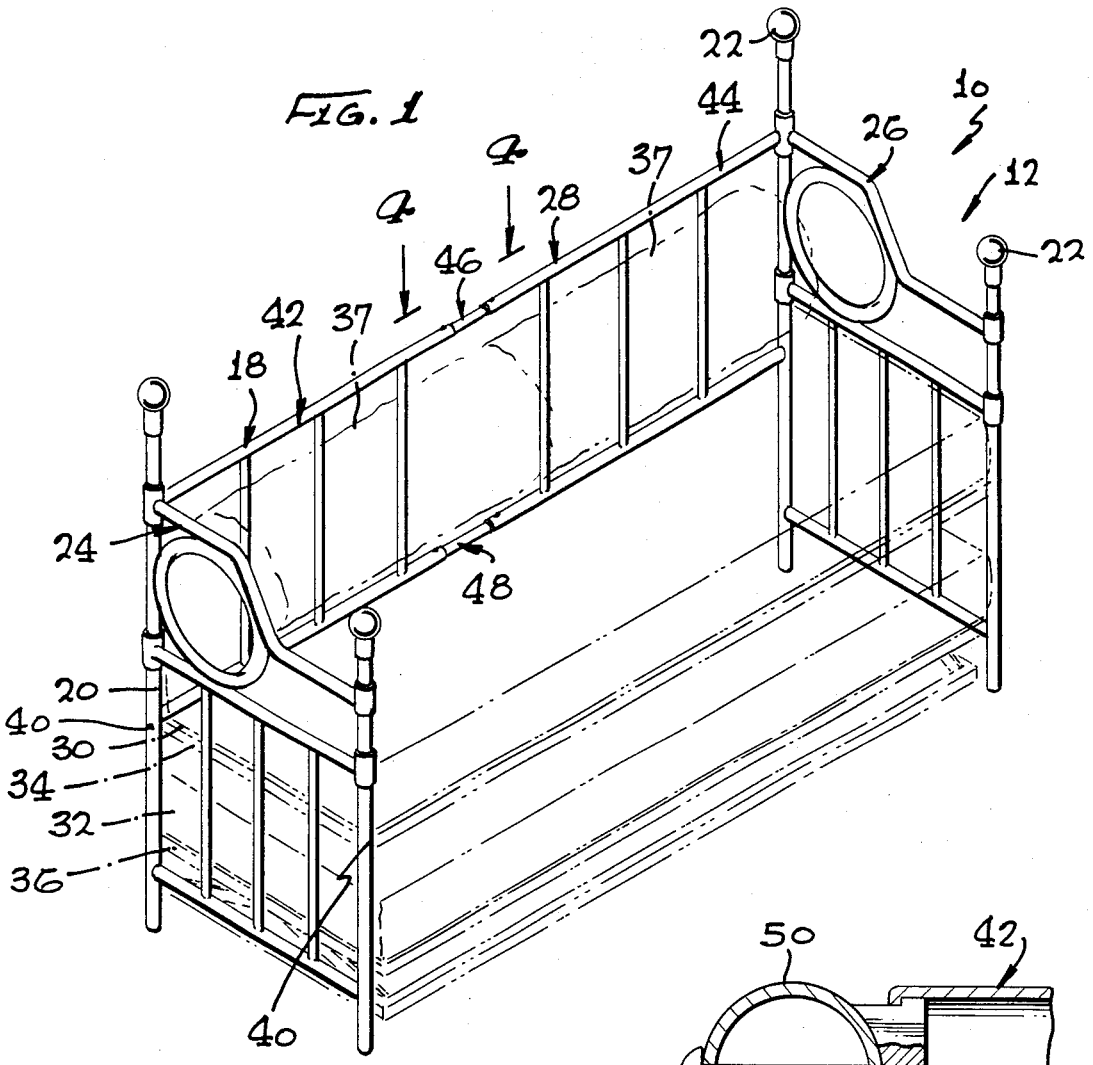
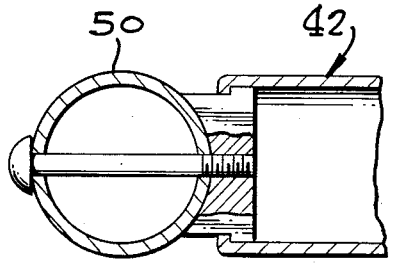
FIG. 5
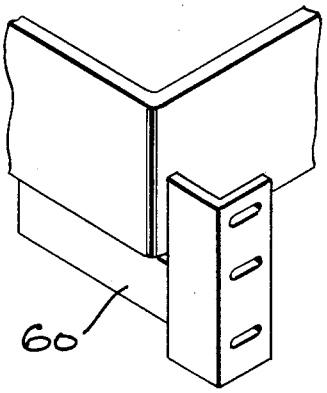
FIG. 6
FIG. 4
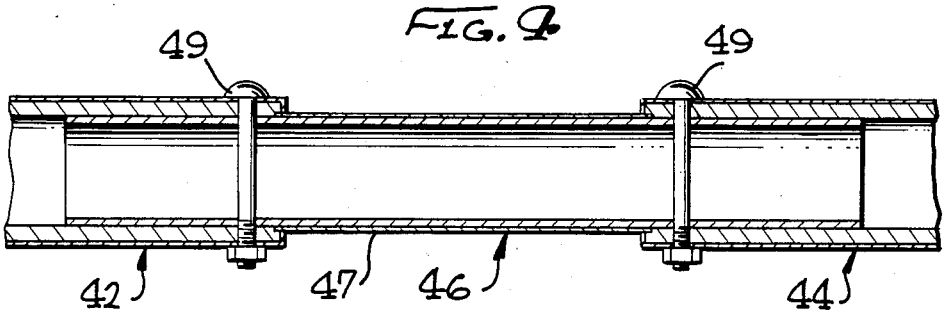

CONVERTIBLE SOFA-BED

BACKGROUND OF THE INVENTION

One type of convertible sofa-bed apparatus includes a highly-decorative sofa frame assembly which holds a mattress support on which a mattress lies. In the sofa configuration, people sit on a cover lying on the mattress, while in the bed configuration, a person lies on the mattress. The highly-decorative sofa-bed apparatus can convert to a bed configuration by merely removing the back frame, so the end frames of the sofa form a headboard and footboard for the bed configuration. In order to store a second bed, a trundle bed is provided which has a folding frame somewhat shorter than usual and a mattress on it. The trundle bed is stored under the mattress and mattress support when the apparatus is in the sofa configuration. The trundle bed has no headboard or footboard. When the beds are set up in a room, there is a stark contrast between the highly-decorative bed formed from the sofa frame assembly and the trundle bed which is devoid of a headboard and footboard. It would be highly advantageous if both beds could be made highly decorative in the bed configuration, provided that an entire highly-decorative headboard and footboard did not have to be provided which would increase the cost and make storage of the additional headboard and footboard inconvenient.

SUMMARY OF THE INVENTION

In accordance with one embodiment of the present invention, a convertible sofa-bed type of apparatus is provided, which enables the conversion of a decorative sofa which has a bed hidden thereunder, into two beds that each have a decorative headboard and footboard, as well as the reverse conversion. In the sofa configuration, a decorative sofa frame assembly is present which includes end frames and a back frame that connects them. The back frame can be disassembled into two separate frame sections which each form at least part of an end board (headboard or footboard) of each of the two beds into which the sofa is transformed.

The novel features of the invention are set forth with particularity in the appended claims. The invention will be best understood from the following description when read in conjunction with the accompanying drawings.

BRIEF DESCRIPTION OF THE DRAWINGS

FIG. 1 is a perspective view of a convertible sofa-bed apparatus shown in its sofa configuration.

FIG. 3 is a perspective view of a second bed constructed from the apparatus of FIG. 1.

FIG. 4 is a view taken on the line 4—4 of FIG. 1.

FIG. 5 is a view taken on the line 5—5 of FIG. 2.

FIG. 6 is a perspective view of a portion of the apparatus of FIG. 3.

DESCRIPTION OF THE PREFERRED EMBODIMENTS

Figure 2:
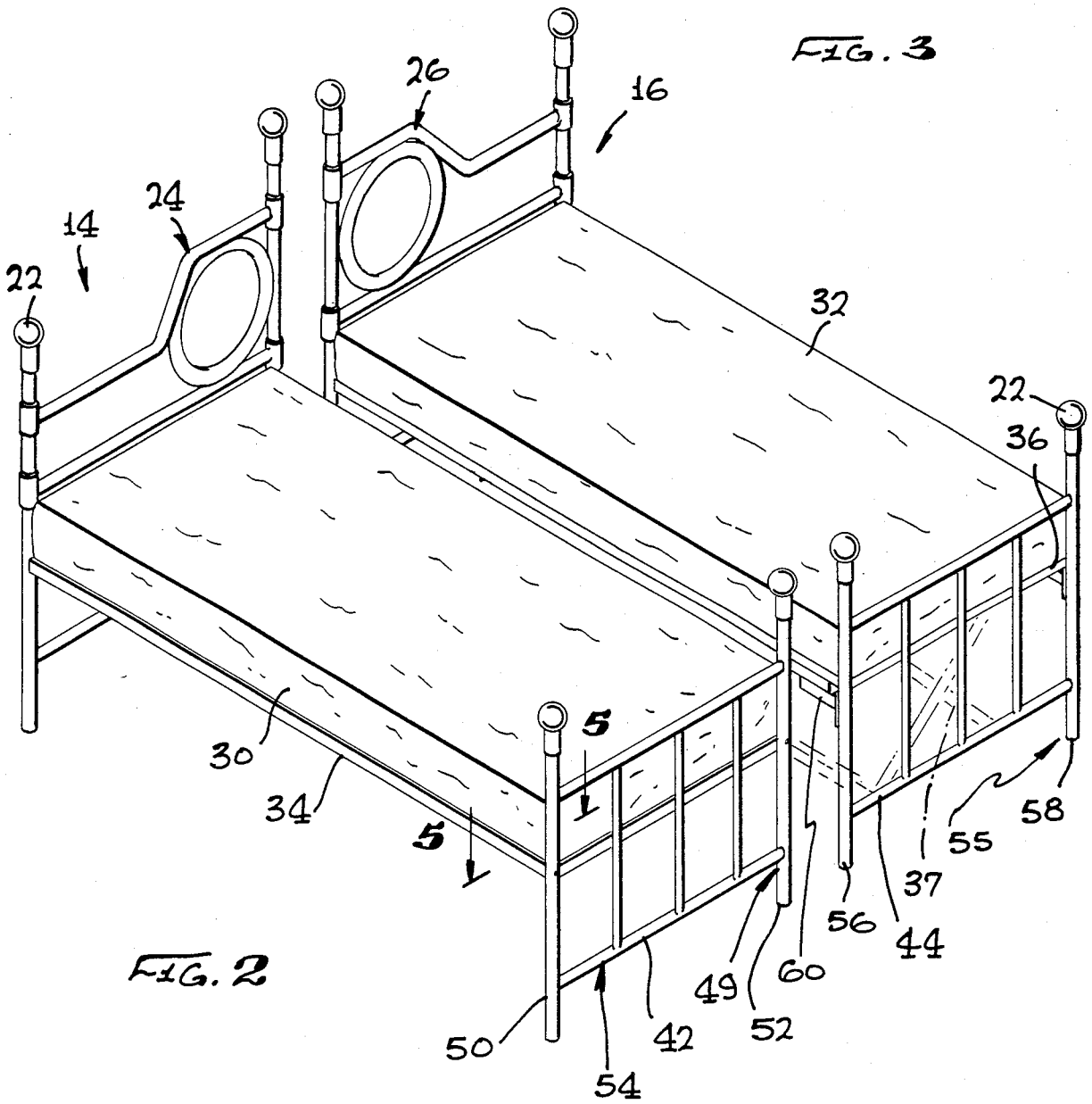
FIG. 2 is a perspective view of a first bed which is constructed from the apparatus of FIG. 1.

FIG. 1 illustrates a convertible bed-sofa apparatus 10 which can serve as a sofa in the configuration 12, and which can be converted into two beds shown in FIGS. 2 and 3 at 14 and 16. In the sofa configuration 12 (FIG. 1), the apparatus includes a highly-decorative frame assembly 18 which may include primarily enamelled parts 20 with polished brass fittings 22. The frame assembly includes a pair of end frames 24, 26 and a back frame 28 whose opposite ends are connected to the end frames. A pair of elongated mattresses 30, 32 and a pair of elongated mattress supports 34, 36 are arranged in a stack, with the end frames 24, 26 at opposite ends of the stack and a back frame 28 lying beside one side of the stack. The topmost mattress 30 is intended to be sat upon in the sofa configuration of FIG. 1. The topmost mattress support 34 is supported at locations 40 onto the end frames, so it can support the topmost mattress. The bottommost mattress 32 and mattress support 36 are stored on the floor under the top mattress support. A group of decorative pillows 37 support the back of a sitting person.

The bottommost mattress support 36 can be a pop-up bed which can roll out from the rest of the sofa and which can pop up to support a mattress a distance above the ground. Both mattresses 30, 32 are of the standard twin-bed size (37½″×74″) and two beds can be provided by merely sliding out the lower mattress support and lower mattress and raising them into a second bed. The sofa itself can serve as the other bed, with the back frame removed to provide a more bed-like appearance. However, the second bed formed by the second mattress 32 and a pop-up second mattress support at 37, will not have a decorative appearance. If the two beds are to be used for an extended period, the second bed may detract from the appearance of a room containing it.

In accordance with the present invention, substantially all of the highly-decorative frame assembly 18 is used, so as to provide two beds that both have a highly-decorative appearance. This is accomplished by constructing the back frame 28 so it can be divided into first and second opposite sections 42, 44. In the sofa configuration, the two sections are held in alignment by a pair of splices 46, 48. In this example, each splice is formed of a tube with an enamelled middle portion that matches the enamelled coating on the rest of the back frame. As shown in FIG. 4, the splicing element 47 is detachably held by fasteners 49 to the ends of the back frame sections, in a manner that permits disassembly. When these splices are disassembled so the back frame sections are separated, each back frame section can serve as a footboard. As shown in FIG. 2, a pair of legs 50, 52 are attached to opposite ends of the back frame section 42 to form a footboard 54. The footboard is attached to an end of the upper mattress support 34 to support one end of it above the ground. The opposite end of the mattress support is supported by an end frame 24. To make this transformation, it is necessary to remove the other end frame from the mattress support 34 and attach the footboard 54 formed by the first back frame section 42 and the legs 50, 52, in its place.

The other bed shown at 16 in FIG. 3, is similarly decorated with a headboard formed by the end frame 26, and a footboard 55 formed by the second back frame section 44, which is supported by another pair of legs 56, 58. Thus, two highly-decorative and mirror-image matching beds are provided which can be used for an extended period in a room. It is possible to form the back frame so each section thereof already has legs that are present even in the sofa configuration. The length of the splices is chosen to take up discrepancies between the length of each back section (plus legs to be attached) and the width of the footboard of the bed. The length of each back frame section is about equal (within a foot) of that of the end frames, although the back frame sections are a few inches shorter until the legs are attached to them.

In FIG. 1, the lowermost mattress support 36 has a smaller (about 4" less) length than the upper mattress support in order to easily slide thereunder. When the lower mattress support 36 is raised as in FIG. 3, it will have adequate length to support the mattress 32 (with only a small overhang), but not sufficient length to extend slightly beyond the opposite ends of the mattress in order to attach to the headboard and footboard. To enable such attachment, applicant provides a pair of extension brackets 60 which attach to the end of the frame 36 and to the legs 56, 58 of the footboard.

The two beds 14, 16 (FIGS. 2 and 3) can be converted into a highly-decorative sofa by first detaching the footboards 49, 55 from the two mattress supports, so parts of the footboards can be converted into a back frame. In FIGS. 2 and 3 the legs 50, 52, 56, 58 have to be detached from the back frame sections 42, 44 before the sections can be spliced into a back frame. An end frame such as 26 from one of the beds is attached at the location where one of the footboards 54 was removed, and the assembled back frame is attached to extend between the end frames. The mattress support 36 and mattress 32 are then stored under the mattress support 34.

In the sofa configuration, the only parts that have to be stored are the four legs 50, 52, 56, 58, the two extension brackets 60, and miscellaneous hardware. This is a relatively small package that can be easily stored in the closet, or even under the sofa. In the two-bed configuration, the only parts that have to be stored are the splices 46, 48 that hold the back frame sections together, and such storage is substantially negligible.

Thus, the invention provides a convertible sofa-bed apparatus which is highly decorative in both its sofa and bed configurations. This is a accomplished by constructing the back frame used in the sofa configuration, as two separate back frame sections that are held together in the sofa configuration and divided in the bed configuration to form part or all of the headboards of two beds. It is possible to have built-in legs on the back frame to avoid the need for mounting additional legs thereto.

Although particular embodiments of the invention have been described and illustrated herein, it it recognized that modifications and variations may readily occur to those skilled in the art, and consequently, it is intended that the claims be interpreted to cover such modifications and equivalents.

What is claimed is:

1. In a convertible sofa-bed type of apparatus which, in a sofa-type configuration includes a pair of elongated mattresses and a pair of elongated mattress supports which are all stacked with a first mattress at the top of the stack for sitting on, said stack having opposite ends and opposite sides, and which also includes a frame assembly having a pair of opposite end frames at opposite ends of said stack and a back frame lying beside one side of said stack and extending between its opposite ends, with opposite ends of the back frame connected to said end frames, the improvement wherein:

said back frame has first and second opposite sections and means for releasably holding said sections in alignment for use in a sofa-type configuration, and for enabling separation of said sections;

means for attaching each back frame section to a second end of each of said mattress supports, and for attaching one of said end frames to a first opposite end of each of said mattress supports, whereby in the bed configuration the beds each have a decorative footboard and headboard.

2. The improvement described in claim 1 wherein:

said matresses have substantially equal lengths, but a second of said mattress supports is shorter than a first of said mattress supports; and said means for attaching includes a pair of extension brackets which, in the bed configuration, have an inner end attached to said second mattress support and an outer end coupled to one of said back frame sections.

3. The improvement described in claim 1 wherein:

each back frame section has a length which is about the same as the length of each end frame.

4. The improvement described in claim 1 including:

a pair of legs removably attachable to opposite ends of each back frame assembly to support it on a floor.

5. A convertible sofa-bed apparatus comprising:

a pair of twin-bed mattresses;

a pair of mattress supports;

a sofa frame assembly which includes a pair of end frames and a back frame which is about twice as long as each end frame, said back frame extendable between said end frames and attachable to them to hold them apart;

said mattresses and mattress supports being stackable for use in a sofa configuration with a second mattress support lowermost, a second mattress lying on the second support, a first support lying over the second mattress and attached to the sofa frame assembly, and a first mattress lying over the first mattress support;

said sofa frame assembly being capable of being disassembled with at least one end frame detachable from the back frame and being attachable to one end of one of said mattress supports;

said back frame having opposite end sections and means detachably joining said end sections, each end section having about the same length as one of said end frames; and two pairs of legs, each pair attachable to the opposite sides of a back section to form a footboard, and including means for attaching each footboard to an end of a mattress support opposite the end frame.

6. The apparatus described in claim 5 wherein:

said second mattress support and second mattress form a bed which can slide under the first mattress support when the first mattress support is attached to the sofa frame in a sofa configuration, said second mattress support being shorter than said first mattress support; and said means for attaching includes an extension bracket having an inner end attached to an end of said second mattress support and an outer end attachable to a footboard.

7. A method for converting a sofa apparatus which includes a decorative sofa frame assembly with opposite end frames and a back frame, and which also includes a top twin bed-size mattress supported on a first mattress support mounted on the sofa frame and a twin bed-size second mattress and second mattress support lying under the first support, into two twin-size beds that each include a decorative headboard and footboard, comprising:

disconnecting the back frame from the end frames and disconnecting a second end frame from the first mattress support;

coupling said second end frame to an end of said second mattress support;

separating said back frame into two sections that each have a width about equal to the width of said mattresses, and attaching legs to the opposite sides of each section, to form a pair of footboards;

coupling each footboard to an end of a mattress support opposite the end to which an end frame is coupled.

8. The method described in claim 7 wherein:

said steps of coupling including attaching the inner end of an extension bracket to an end of said second mattress support and the outer end of the bracket to one of said footboards.

* * * * *